United States Patent [19]

Kobayashi et al.

[11] 4,149,463

[45] Apr. 17, 1979

[54] INK FEEDING APPARATUS FOR AN OFFSET PRINTING PRESS

[75] Inventors: Shozaburo Kobayashi, Takatsuki; Kenji Yamauchi, Yokohama, both of Japan

[73] Assignee: Dodwell & Company Limited, London, England

[21] Appl. No.: 760,009

[22] Filed: Jan. 17, 1977

[30] Foreign Application Priority Data

Jan. 16, 1976 [JP] Japan ..... 51-3320
Oct. 8, 1976 [JP] Japan ..... 51-135611

[51] Int. Cl.[2] ..... B41F 31/08
[52] U.S. Cl. ..... 101/366; 101/365; 415/72
[58] Field of Search ..... 101/363, 365; 415/72, 415/366

[56] References Cited

U.S. PATENT DOCUMENTS

| | | | |
|---|---|---|---|
| 769,499 | 9/1904 | Sheetz | 101/363 |
| 1,997,612 | 4/1935 | Webern et al. | 101/366 |
| 2,719,484 | 10/1955 | Wardell et al. | 101/363 |
| 3,326,123 | 6/1967 | Smalley | 101/365 |
| 3,381,801 | 5/1968 | Rastoin | 415/72 |
| 3,704,076 | 11/1972 | Bodrnov et al. | 415/72 |
| 3,723,020 | 3/1973 | Watanabe | 415/72 |
| 3,767,098 | 10/1973 | Pabodie | 101/288 |
| 3,807,708 | 4/1974 | Jones | 415/72 |

*Primary Examiner*—William Pieprz
*Attorney, Agent, or Firm*—Martin A. Farber

[57] ABSTRACT

An ink feeding apparatus used for an offset printing press being adapted to provide simultaneous ink agitation substantially along the entire length of the ink supply line so that ink can be fed little by little continuously in operation as soon as it starts, thereby enabling the smooth feeding of ink for the next operation and to prevent droplet falling of ink.

6 Claims, 2 Drawing Figures

INK FEEDING APPARATUS FOR AN OFFSET PRINTING PRESS

BACKGROUND OF THE INVENTION

This invention relates to an ink feeding apparatus for an offset printing press which uses highly viscous ink for printing.

In commonly accepted technique of the offset printing press using highly viscous ink, an operator feeds ink by hand with a few exceptions. Otherwise, due to the recent automatization, an automatic system has been employed in a part of the field which uses a pump for feeding ink. In this pump system, ink is fed by the pump from an ink tank to a printing press through a pipe line. However, a web type offset printing press uses a highly viscous ink which is accompanied with the well known thixotropic phenomenon, and furthermore it is required to be able to feed ink little by little continuously because the common usage of ink is for a considerably small rate, for example, at one or two liters per hour. Thus, this system with pump includes the following disadvantages.

Namely, during operation of the printing press, the ink is held at a suitable viscosity for printing by pressurization as well as by the simultaneous agitation thereof by means of the pump. However when the pump is stopped, upon stopping an operation of the printing press, which ends the ink feeding, then the ink contained in the pipe line returns to the original highly viscous liquid again. This causes a difficulty in feeding the ink for the next operation, because the conventional prior art employs a pump larger than required for incessant circulation of ink, and also the thixotrophic phenomenon of ink is delayed most at the end of the pipe line in the printing press. When ink in this portion becomes a soft viscous liquid, there the so called "dropping", i.e. "droplet falling" phenomenon occurs in which an amount of ink drops or is poured out intermittently. Therefore, control of the flow rate of the ink is required, which flow rate control is difficult to achieve. Therefor in the case of an offset printing press which requires a continuous feeding of ink little by little as described, this pump system is not adequate. Furthermore, with respect to an offset printing press, an ink receiver used therein should be washed out whenever a coloured pattern is changed. Accordingly, the pump system which is necessarily accompanied with the "droplet falling" phenomenon cause a large loss of ink. This disadvantage is based on the fact that only a pump serves to pressurize and to agitate ink in the pipe line used for ink feeding.

SUMMARY OF THE INVENTION

The object of the invention is, in view of this point, to provide an improved ink feeding apparatus for an offset printing press, which is so arranged that ink is pressurized and simultaneously agitated in almost the entire length of an ink feeding line in order to enable the continuous feeding of ink little by little.

The present invention and its objects and advantages will become more apparent in the detailed description of the preferred embodiments of the invention.

DESCRIPTION OF THE PREFERRED EMBODIMENTS

Figure 1:
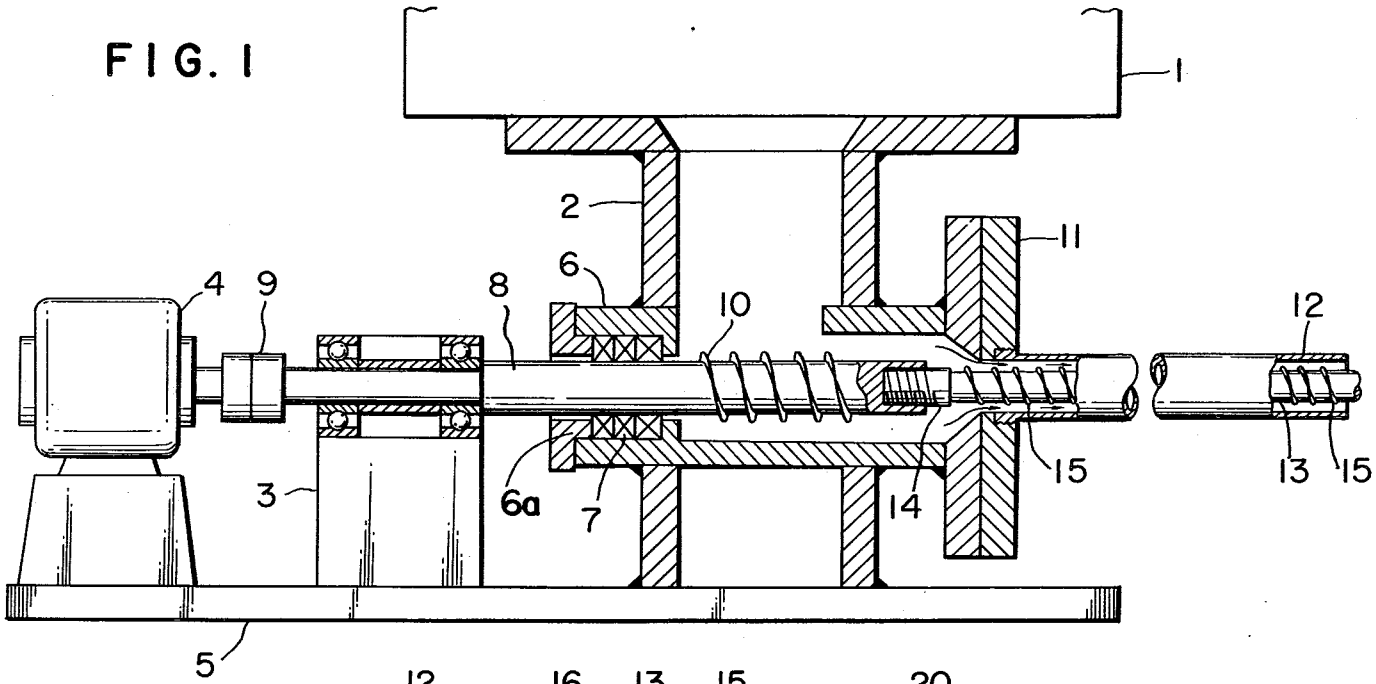
FIG. 1 is a sectional view of an ink feeding apparatus embodied by the present invention.

Referring now to the accompanied drawings, reference numeral 1 denotes an ink tank storing therein highly viscous ink for an offset printing press. This tank 1 is provided with an ink stock portion or member 2 with a relatively small volume at the bottom of the tank. In the proximity of the stock portion 2, there are disposed a bearing stand 3 and a drive electric motor 4 which are together mounted on a base 5.

The stock portion 2 has hermetically secured thereto a tubular member 6 which extends horizontally through the same. A portion of the tubular wall of the tubular member 6 positioned at the side of the stock portion 2 is cut out to communicate with the stock portion 2. Inserted in this tubular member 6 is a rotary shaft 8 which is sealed at one side by a sealed bearing 7. A flanged cover member *6a* closes an end of the tubular member 6 adjacent the sealed bearing 6 and abuts against the latter. This rotary shaft 8 is supported by the described bearing stand 3 and connected at one end to rotating shaft of said electric motor 4 by means of coupling 9. Also, rotary shaft 8 is formed with a spiral thread 10 at the peripheral surface thereof which is located within the stock portion 2.

Further, the tubular member 6 is connected at the right end in the drawing to a flexible pipe 12 of an ink feeding line for communication therewith by means of a connector 11. Contained within the flexible pipe 12 is a flexible core rod 13 of smaller diameter than the latter and which extends through almost the entire length of the flexible pipe 12. This flexible core rod 13 is fixed to the free end of said rotary shaft 8 by means of a member 14. Thus, when the drive motor 4 is driven, its rotation is transferred to the rotary shaft 8 so that the spiral thread 10 as well as the flexible core rod 13 are rotated together. The flexible core rod 13 is formed with a spiral thread 15 on the peripheral surface thereof along its entire length.

Figure 2:
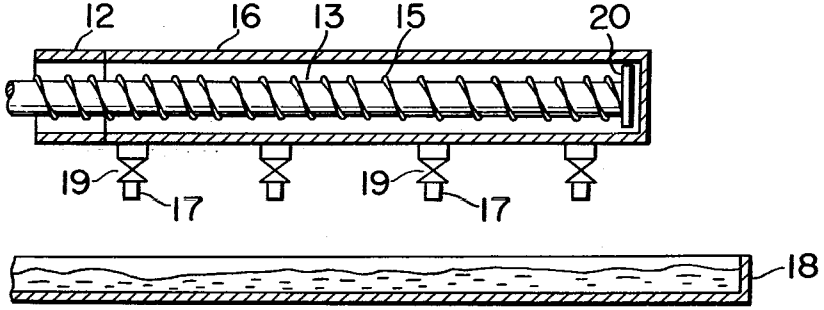
FIG. 2 is also a sectional view of a portion at the side of the ink distributor of the apparatus shown in FIG. 1.

FIG. 2 illustrates the ink distributor portion to be mounted on an original ink roller portion of a printing press. A distributor pipe 16 with one end closed, is joined to the flexible pipe 12 and branch supply nozzles 17 are secured in common to the distributor pipe 16 to feed ink to an ink receiver 18 of the ink roller portion. These members are adapted to move slowly in the horizontal direction along ink receiver 18 by a suitable reciprocating mechanism not shown. Cocks 19 are fixed on the branch supply nozzles 17, respectively.

The flexible pipe 12 is detachably connected to the open end of the distributor pipe 16 for communication therewith, and the flexible core rod 13 contained therein extends within the distributor pipe 16. The end of the core rod 13 is provided with a push member 20 with a diameter slightly smaller than the internal diameter of the distributor pipe 16 thereby to prevent the flexible core rod 13 from shaking in the distributor pipe 16.

Referring now to the operation of the described arrangement. Since the flexible core rod 13 is rotated in operation, agitation of the highly viscous ink simultaneously occurs, which enables a smooth feeding of ink during the operation. Namely, there is a clearance between the inner peripheral surface of the flexible pipe 16 and the outer periphery of the spiral thread 15 of the flexible core rod 13. Accordingly, the rotation of the spiral thread 15 generates agitation in the clearance between a stagnant ink portion and the fed-out ink. Because such an agitation occurs simultaneously along the entire line, a uniform kneading of ink is obtained which leads to an ideal viscosity. In addition, now that both spiral threads 10 and 15 are rotated together, ink will be simultaneously pressurized along the entire supply line by the spiral threads 10 and 15, so that it is fed little by little continuously to distributor pipe 16 through the supply line of the clearance between the flexible pipe 12 and the core rod 13, and then is fed from the distributor pipe 16 to the ink receiver 18 through respective branch supply nozzles 17.

According to the arrangement of the invention, the following advantages are obtainable. Since ink agitation and feeding occur simultaneously along almost the entire length of the ink supply line by rotation of the flexible core rod 13, the drive electric motor can be of a small capacity. Also, since the ink supply line is of a flexible structure, not only is its treatment easy, but also the connected end of the line can be detached from the distributor pipe 16 and then inserted into the ink tank 1 to form a closed return feed circuit of the ink supply line without going through the printing portion, to thereby maintain the soft viscous condition of the ink by a continuous pressurization-agitation operation, which makes the printing press suitable for temporarily stopping the operation and provides conveniences in operation. Otherwise, an offset printing press is provided with this type of ink feeding apparatus relative to each colour so as to effect multi-coloured printing with four primary colours or by combination of these primary colours. So it will be probably required to regulate the amount of these primary colours due to a coloured pattern. However, since the prior art pump system as described can not easily control the ink amount particularly during starting, an operator who stands near the relevant printing press section must perform such regulation of ink amount by hand. On the other hand, because the present invention enables the smooth ink feeding at a time of starting, the amount of ink which is fed can be controlled by controlling the speed of the drive electric motor of each ink feeding apparatus or by connecting the electric motor with a timer, i.e. effecting intermittent driving with a time setting. Therefore an arbitrarily fed ink control can be realized according to a coloured pattern without any operator therefor which is useful even with a saving of labor. Furthermore, in the distributor pipe 16, both feeding and agitation of ink are simultaneously effected as in the flexible supply line, and thus ink is fed little by little to the ink receiver 18 through the respective nozzles 17, so that a stagnant condition resulting in piling up due to droplet falling, as caused in the prior art, can be avoided, said piling up being commonly generated in the ink receiver at the end of the supply nozzle.

The described apparatus can employ various types of electric motors as drive electric motor, while the motor is, in view of its characteristics, preferably a DC series motor, the speed of which is varied due to a load applied thereof. Also, ink tank stock portion 2 includes therein the rotary shaft 8 which is formed with the spiral thread 10, while instead of this spiral thread 10, the flexible core rod 13 formed with a spiral thread 15, can be inserted into this stock portion 2. Other, various modifications will be created without departing from the scope of the invention. Further, since the ink feeding line in the apparatus of the invention is of smaller cross-section and thus has a limited influence in viscosity variation, highly viscous ink in an ordinary offset printing press other than the web type can be fed instantaneously and smoothly by smaller power.

As mentioned above, the ink feeding apparatus for an offset printing press according to the invention is adapted to provide simultaneous ink agitation substantially along the entire length of the ink supply line, so that in this apparatus, the ink can be fed little by little continuously simultaneously upon starting.

We claim:

1. An ink feeding apparatus for an offset printing press, comprising an ink tank, an ink stock member adapted to be secured to a bottom of said ink tank communicating therewith and having a small volume relative to said ink tank, a tubular member secured to and extending horizontally through said ink stock member communicating therewith, a rotary shaft extending through said tubular member and rotatably mounted therein, said rotary shaft having a spiral thread on a peripheral surface thereof, an electric motor spaced from one end of said tubular member being operatively connected to said rotary shaft at one end of the latter, a flexible pipe connected at one end thereof to the other end of said tubular member communicating with said tubular member, a flexible core rod secured to the other end of said rotary shaft for joint rotation therewith, said flexible core rod having a spiral thread on a peripheral surface thereof along the entire length thereof, a distributor pipe having an open end detachably connected to the other end of said flexible pipe communicating therewith, said distributor pipe having a closed free end, said flexible core rod extending through said flexible pipe and said distributor pipe to adjacent said closed free end of said distributor pipe, said distributor pipe having a plurality of branch supply nozzles communicating therewith, through which ink is adapted to be fed to an ink receiver of an ink roller, whereby ink can be fed to the ink receiver a little at a time continuously, so that said flexible core rod can be inserted into said ink stock member via said tank when said distributor pipe is detached from said flexible pipe and said flexible core rod is removed from said distributor pipe, to form a closed ink circuit for agitation of the ink in said ink stock member by operation of said electric motor.

2. The ink feeding apparatus for an offset printing press as set forth in claim 1, wherein said flexible core rod includes a free end thereof having a push member means for preventing said flexible core rod from shaking.

3. The ink feeding apparatus for an offset printing press as set forth in claim 2, wherein said push member means is adjacent said closed free end of said distributor pipe and has a diameter greater than that of said flexible core rod and slightly smaller than the inner diameter of said distributor pipe.

4. An ink feeding apparatus for an offset printing press, comprising an ink stock member adapted to be secured to a bottom of an ink tank communicating therewith and having small volume relative to said ink tank, a tubular member secured to and extending horizontally through said ink stock member communicating therewith, a rotary shaft extending through said tubular member and rotatably mounted therein, said rotary shaft having a spiral thread on a peripheral surface thereof, an electric motor spaced from one end of said tubular member being operatively connected to said rotary shaft at one end of the latter, a flexible pipe connected at one end thereof to the other end of said tubular member communicating with said tubular member, a flexible core rod secured to the other end of said rotary shaft for joint rotation therewith, said flexible core rod having a spiral thread on a peripheral surface thereof along the entire length thereof, a distributor pipe having an open end connected to the other end of said flexible pipe communicating therewith, said distributor pipe having a closed free end, said flexible core rod extending through said flexible pipe and said distributor pipe to adjacent said closed free end of said distributor pipe, said distributor pipe having a plurality of branch supply nozzles communicating therewith, through which ink is adapted to be fed to an ink receiver of an ink roller, whereby ink can be fed to the ink receiver a little at a time continuously, said tubular member extends at both of said ends thereof beyond said ink stock member, a connector means for connecting said tubular member with said flexible pipe, said connector means is formed with a conical opening narrowing in a direction toward said flexible pipe and communicates said tubular member with said flexible pipe, said tubular member is formed with an opening at an upper portion thereof inside of said ink stock member communicating the latter with said tubular member, a sealed bearing disposed inside of said tubular member at said one end of said tubular member and seals said rotary shaft thereat, a flanged cover member closes said one end of said tubular member adjacent said sealed bearing and abuts against the latter, the peripheral surface of said rotary shaft has an outer diameter greater than that of said flexible core rod, a threaded member coaxially securing said flexible core rod to said rotary shaft.

5. The ink feeding apparatus for an offset printing press as set forth in claim 4, further comprising means for coupling said motor with said rotary shaft for rotating the latter by the former.

6. The ink feeding apparatus for an offset printing press as set forth in claim 4, further comprising cock means disposed on said branch supply nozzles respectively for controlling the flow of ink from the latter.

* * * * *